United States Patent [19]

Eckert

[11] 4,440,337

[45] Apr. 3, 1984

[54] METHOD OF PRODUCING SIMILAR DEEP-DRAWN PARTS

[75] Inventor: Rolf Eckert, Bergisch Gladbach, Fed. Rep. of Germany

[73] Assignee: Klöckner-Humboldt-Deutz Aktiengesellschaft, Cologne, Fed. Rep. of Germany

[21] Appl. No.: 309,724

[22] Filed: Oct. 8, 1981

[30] Foreign Application Priority Data

Oct. 10, 1980 [DE] Fed. Rep. of Germany ..... 3038276

[51] Int. Cl.[3] ..... B21C 37/08; B21D 22/20

[52] U.S. Cl. ..... 228/173 C; 29/157 R; 29/423; 29/455 R; 29/463; 29/527.5; 72/347; 138/148; 264/266; 264/279.1; 264/DIG. 64; 285/183; 285/41; 228/182

[58] Field of Search ..... 228/173 C, 182; 29/527.5, 463, 455 R, 157 R, 157.3 R, 423; 72/347, 363, 368; 413/69; 138/148, 177; 285/183, 179, 41, 133 R, 138; 220/469; 493/906, 908, 99, 902; 264/266, 279.1, DIG. 57, DIG. 64

[56] References Cited

U.S. PATENT DOCUMENTS

| | | | |
|---|---|---|---|
| 90,322 | 5/1869 | Vanstone | 228/173 C |
| 1,851,559 | 3/1932 | Arey | 285/133 R X |
| 2,005,591 | 6/1935 | Meyercord | 29/423 X |
| 2,270,185 | 1/1942 | Dulmage | 72/347 X |
| 3,206,836 | 9/1965 | Schlussler | 29/463 X |
| 3,949,552 | 4/1976 | Kaneko et al. | 60/282 |
| 4,206,598 | 6/1980 | Rao et al. | 164/98 X |
| 4,243,093 | 1/1981 | Nieman | 164/98 X |

FOREIGN PATENT DOCUMENTS

| | | | |
|---|---|---|---|
| 2720451 | 11/1977 | Fed. Rep. of Germany | 285/133 R |
| 33913 | 11/1964 | German Democratic Rep. | 72/347 |

*Primary Examiner*—Nicholas P. Godici
*Assistant Examiner*—Charles L. Willis
*Attorney, Agent, or Firm*—Becker & Becker, Inc.

[57] ABSTRACT

A method of producing similar deep-drawn parts for double-walled structural parts having uniformly spaced walls and edge welding. During every deep-drawing procedure, a respective planar outer plate, which is placed upon the lower part of the tool, as is a filler plate, as well as a preformed or preshaped inner plate, which is placed over the tool punch, are shaped in common, whereby the preformed inner plate and the outer plate receive their final form or shape, and the filler plate is deformed into a preshaped inner plate for a subsequent deep-drawing procedure. The tool for carrying out this method is characterized in that the smallest spacing between the tool punch and the lower part of the tool corresponds to the entire thickness of the two inner plates and one outer plate.

4 Claims, 4 Drawing Figures

METHOD OF PRODUCING SIMILAR DEEP-DRAWN PARTS

The present invention relates to a method of producing similar deep-drawn parts for double-walled structural parts having uniformly spaced walls and edge welding. Insulating linings or through-flow cooling mantles can be formed for instance with such structural parts.

Similar deep-drawn plates for double-walled structural parts can be formed either in two similar independent tools, or in a single tool accompanied by the utilization of a respectively interposed shaped plate. In the first situation, double tool and operating costs result, and as a result of different wear on the tools, non-uniform wall spacing occurs. In the second situation, especially with a very narrow intermediate space and a correspondingly thin shaped plate, the latter is subjected to an unduly high consumption rate as a result of continuous elastic deformation and continuous surface wear. The production of the shaped plate likewise requires a further tool.

It is an object of the present invention to make similar deep-drawn plates in a single tool while avoiding an intermediate plate which is subjected to intensive wear.

This object, and other objects and advantages of the present invention, will appear more clearly from the following specification in connection with the accompanying drawing, in which.

The method of the present invention is characterized primarily in that during every deep-drawing procedure, a respective planar outer plate, which is placed upon the lower portion of the tool, as is a filler plate, as well as a preformed or preshaped inner plate, which is placed over the tool punch, are shaped in common, whereby the preshaped inner plate and the outer plate receive their final form or shape, and the filler plate is deformed into a preshaped or preformed inner plate for a subsequent deep-drawing procedure.

According to the present inventive method, the inner plate is brought into its final form or shape in two operations in a material-saving manner. By utilizing the later-to-be-used inner plate first as an intermediate form or mold, a uniform width of intermediate space is inventively produced.

The utilized pressing tool is inventively embodied in such a way that the smallest spacing between the tool parts, i.e. the lower portion of the tool and the punch, corresponds to the total thickness of two inner plates and one outer plate. The similar deep-drawn plates produced according to the inventive method, as required, are connected by spot welding or seam welding along their edges into double-walled structural parts, whereby suitably an edge plate strip can be inserted between the inner plate and the outer plate. If this connection occurs only along two oppositely located lines which are not connected with each other, the double-walled structural part can have a medium flowing therethrough for cooling or heating purposes. Inlet and outlet openings can be produced by appropriate configuration of the edges of the plates or by their size in relation to the tool. A rim can be produced along the edge of the inner plate by having a rounded-off portion on the tool at the edge of the shaped part; this rim butts against the edge of the outer plate at an angle, whereby without additional finishing, the preconditions for an edge welding are provided.

In a particular inventive application, two double-walled half shells can be connected tinto a hollow body, which itself in turn can have a further medium flowing therethrough. The production of such parts can occur in two steps, though it is especially advantageous, however, to produce such parts by a common edge welding of two inner plates and two outer plates in a single operation along edges to connect them into a double-walled hollow body. Elbows produced in such a manner are especially advantageous as insulating or coolable channels cast into cast metal parts, such as cylinder heads.

Figure 1:
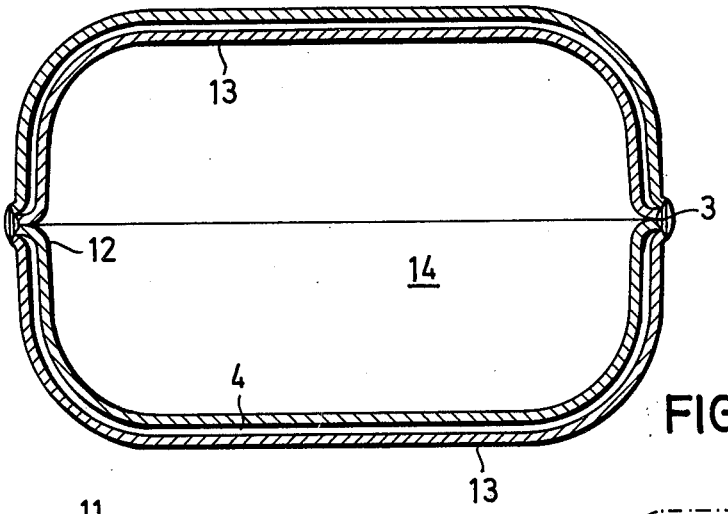
FIG. 1 is a sectional view of a structural part in the form of a double-walled hollow body produced according to the method of the present invention.

Referring now to the drawing in detail, an inner plate 1 and an outer plate 2 of a double-walled structural part are shown. These plates are connected with each other by an edge welding 3. FIG. 1 shows two such double-walled parts which are identical in cross section, in the shape of half shells 13, and are connected into a double-walled elbow 14 longitudinally along the edge welding 3 thereof. These parts consequently form two intermediate spaces or chambers 4 which are separated from one another. The inner plates 1 respectively have a rim 12 which respectively form an angle with the edge of the outer plate 2 along the edge welding 3 thereof.

Figure 2:
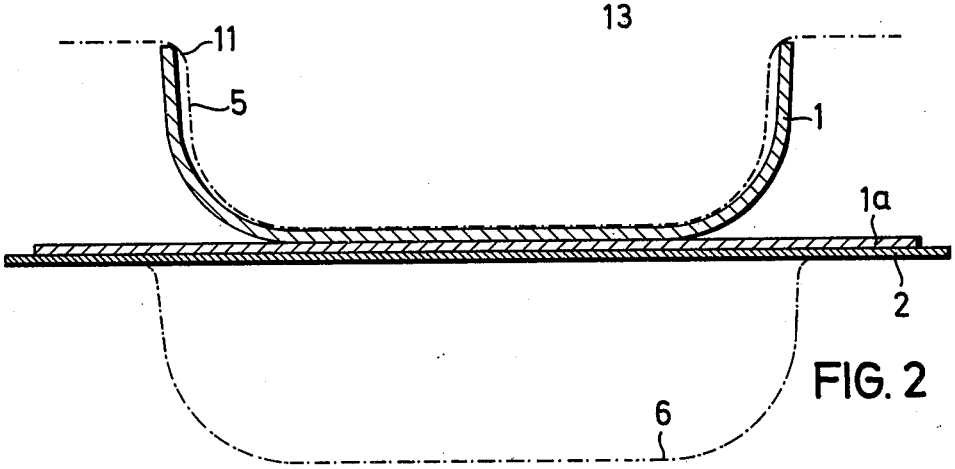
FIG. 2 shows the tool, with plates placed thereon, in the starting position prior to the deep drawing.

FIG. 2 shows in dot-dash lines the punch or die 5 and the lower part 6 of the tool in the starting position, with material supplied thereto. An outer plate 2 and a filler plate 1*a* are placed on the lower part 6; the filler plate 1*a* in turn supports a preformed inner plate 1 which is placed over the punch 5. This preformed inner plate 1 served as a filler plate 1*a* in a previous deep drawing procedure, and in the imminent deep drawing procedure is finish-formed, as is the outer plate 2. In the subsequent deep drawing procedure, the filling plate 1*a* now on the outer plate 2 takes the part of the preformed inner plate 1. The punch 5 and the lower part 6 of the tool have rounded-off portions 11 along the edge of the mold or formed part for producing a rim 12 on the inner plate 1.

Figure 3A:
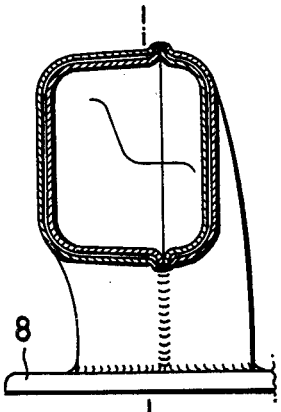
FIG. 3A shows an elevational view.
Figure 3B:
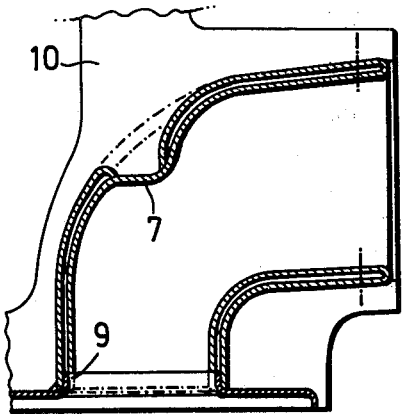
FIG. 3B shows a sectional view of a structural part produced according to the method and in the form of a double-walled elbow cast in a cast metal part.

FIG. 3A illustrates in a plan or elevational view an elbow 14 joined using two inner plates and two outer plates 1, 2, or two half shells 13; this elbow is provided with a bottom plate 8. FIG. 3B illustrates in a cross sectional view the same elbow 14, though cast in a cast metal part 10. Also shown is an inserted valve seat ring 9. In a special finishing operation on an elbow 14, the outer shell 2 is perforated or broken through at the location 7, and the edges are joined with the inner shell 1 in order in this manner to provide the possibility of installing a valve guide.

The present invention is, of course, in no way restricted to the specific disclosure of the specification and drawing, but also encompasses any modifications within the scope of the appended claims.

What I claim is:

1. A method of producing a series of similar deep-drawn parts, for double-walled structural parts having uniformly spaced walls and edge welding, using a tool having a punch and a lower portion for receiving material from, and shaping it in cooperation with, said punch, said method, for each deep-drawing procedure, comprising the steps of:

placing a planar outer plate on said lower tool portion;

placing a planar filler plate upon said outer plate;

placing a preformed inner plate over said punch;

placing said punch, with said inner plate thereon, on said filler plate in such a way that said inner plate is located between said punch and said filler plate;

in common shaping said outer plate, said filler plate, and said inner plate in such a way that said outer and inner plates receive their final form, and said filler plate is deformed;

removing said filler plate from between said formed outer and inner plates; and using said formed filler plate as the preformed inner plate in producing a subsequent deep-drawn part.

2. A method of producing similar deep-drawn parts, for double-walled structural parts having uniformly spaced walls and edge welding, using a tool having a punch and a lower portion for receiving material from, and shaping it in cooperation with, said punch, said method, for each deep-drawing procedure, comprising the steps of:

placing a planar outer plate on said lower tool portion;

placing a planar filler plate upon said outer plate;

placing a preformed inner plate over said punch;

placing said punch, with said inner plate thereon, on said filler plate in such a way that said inner plate is located between said punch and said filler plate;

in common shaping said outer plate, said filler plate, and said inner plate in such a way that said outer and inner plates receive their final form, and said filler plate is deformed into a preformed inner plate for a subsequent deep-drawing procedure; said shaping step including the step of producing a rim in said inner plate, which rim butts against the edge of said outer plate at an angle, and further including the step of edge welding said rim of said inner plate to the edges of said outer plate to form a double-walled structural part.

3. A method of producing similar deep-drawn parts, for double-walled structural parts having uniformly spaced walls and edge welding, using a tool having a punch and a lower portion for receiving material from, and shaping it in cooperation with, said punch, said method, for each deep-drawing procedure, comprising the steps of:

placing a planar outer plate on said lower tool portion; placing a planar filler plate upon said outer plate;

placing a preformed inner plate over said punch;

placing said punch, with said inner plate thereon, on said filler plate in such a way that said inner plate is located between said punch and said filler plate;

in common shaping said outer plate, said filler plate, and said inner plate in such a way that said outer and inner plates receive their final form, and said filler plate is deformed into a preformed inner plate for a subsequent deep-drawing procedure; and connecting the edges of respective inner and outer plates of two similar deep-drawn parts in a common edge welding to form a double-walled hollow body.

4. A method of producing similar deep-drawn parts, for double-walled structural parts having uniformly spaced walls and edge welding, using a tool having a punch and a lower portion for receiving material from, and shaping it in cooperation with, said punch, said method, for each deep-drawn procedure, comprising the steps of:

placing a planar outer plate on said lower tool portion;

placing a planar filler plate upon said outer plate;

placing a preformed inner plate over said punch;

placing said punch, with said inner plate thereon, on said filler plate in such a way that said inner plate is located between said punch and said filler plate;

in common shaping said outer plate, said filler plate, and said inner plate in such a way that said outer and inner plates receive their final form, and said filler plate is deformed into a preformed inner plate for a subsequent deep-drawing procedure; and casting said double-walled structural parts in a cast metal part to selectively form insulating and coolable channels therein.

* * * * *